United States Patent [19]

Hunter

[11] 3,984,730

[45] Oct. 5, 1976

[54] METHOD AND APPARATUS FOR NEUTRALIZING POTENTIALS INDUCED ON SPACECRAFT SURFACES

[75] Inventor: Robert E. Hunter, Seabrook, Md.

[73] Assignee: The United States of America as represented by the Administrator of the National Aeronautics and Space Administration, Washington, D.C.

[22] Filed: July 11, 1975

[21] Appl. No.: 595,197

[52] U.S. Cl. ..... 317/2 D; 244/1 A; 244/42 CG; 324/72

[51] Int. Cl.[2] ..... H05F 3/04

[58] Field of Search ..... 244/1 A, 172, 158, 160, 244/162, 163, 136, 12 R, 42 CG; 317/2 E, 2 D; 324/72; 340/27; 325/15, 115, 65, 4; 323/25–27; 310/6, 7

[56] References Cited

UNITED STATES PATENTS

| | | | |
|---|---|---|---|
| 2,578,697 | 12/1951 | Gunn | 244/1 A |
| 3,095,163 | 6/1963 | Hill | 244/12 R |
| 3,279,176 | 10/1966 | Boden | 244/172 |
| 3,297,281 | 1/1967 | Felici | 244/136 |
| 3,600,632 | 8/1971 | Bright et al. | 317/2 E |
| 3,733,038 | 5/1973 | Ikrath et al. | 317/2 E |
| 3,802,625 | 4/1974 | Buser et al. | 317/2 E |
| 3,826,452 | 7/1974 | Little | 317/2 E |

*Primary Examiner*—Trygve M. Blix
*Assistant Examiner*—Galen L. Barefoot
*Attorney, Agent, or Firm*—John O. Tresansky; Robert D. Marchant; John R. Manning

[57] ABSTRACT

A potential induced on the surface of an orbiting spacecraft is neutralized to the potential of a plasma through which the spacecraft is traveling by directing charged particles into the plasma from the spacecraft surface. The induced potential occurs in response to bombardment of the spacecraft surface by ambient charged particles which may be negative or positive. The charged particles directed into the plasma from the surface have the same polarity as the induced potential to provide the neutralization. The invention can be utilized to maintain different, electrically isolated segments of a spacecraft surface at the same potential to prevent electric discharges between the different parts and thereby protect electric circuits within the spacecraft. The invention can also be utilized to enable charged particle detectors on the surface of a spacecraft to operate more accurately so that the particles are not perturbed by a potential difference between the spacecraft surface and the plasma.

13 Claims, 1 Drawing Figure

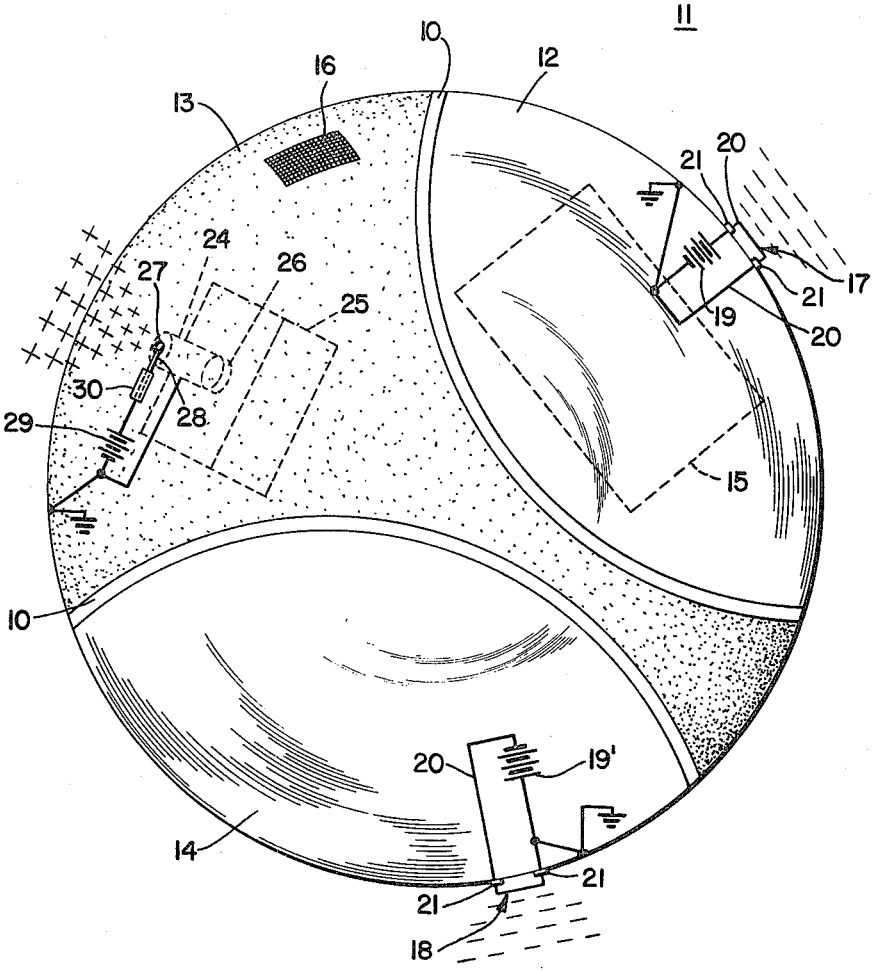
11
10
12
16
13
21
20
24
26
27
25
17
21
19
20
30
28
29
15
10
20
19'
14
21
21
18

METHOD AND APPARATUS FOR NEUTRALIZING POTENTIALS INDUCED ON SPACECRAFT SURFACES

ORIGIN OF THE INVENTION

The invention described herein was made by an employee of the United States Government and may be manufactured and used by or for the Government for governmental purposes without the payment of any royalties thereon or therefor.

FIELD OF THE INVENTION

The present invention relates generally to a method of an apparatus for neutralizing a potential induced on the surface of a spacecraft relative to the potential of a plasma through which the spacecraft travels. More particularly, the invention relates to a method and apparatus wherein charged particles having the same polarity as the induced potential are directed into the plasma from the spacecraft surface.

BACKGROUND OF THE INVENTION

Spacecraft in earth and solar orbit are subject to constant bombardment by charged particles of both positive and negative polarity. The energy of the charged particles bombarding the spacecraft ranges from very low to extremely high values, i.e, from zero electron volts to $10^{10}$ electron volts, in some instances. In response to the charged particle bombardment, the spacecraft exterior surface acquires a potential relative to an ambient plasma through which the spacecraft is traveling. The potential causes the net electric current flow between the spacecraft surface and the ambient plasma to be zero, whereby the numbers of unit positive and negative charges flowing between the plasma and the spacecraft current per unit time are exactly equal. In response to the positive and negative charges flowing between the spacecraft and the ambient plasma, an equilibrium potential is reached or induced on the surface of the spacecraft. The equilibrium potential may be a function of orbital parameters of the spacecraft, solar illumination, solar activity, and the type of material on the spacecraft surface. The factors effecting the spacecraft equilibrium potential are the work function of metals on the spacecraft exterior surface and the nature of the particles bombarding the spacecraft surface. It is believed that the solar energy impinging on the spacecraft metal surface causes photoelectrons to be emitted by the surface, partially or totally compensating for energetic ambient electrons incident upon the spacecraft surface. This conclusion is based on the finding that spacecraft in synchronous earth orbit during eclipse sometimes have surface potentials of several thousand volts negative relative to the plasma through which they are traveling. In contrast, spacecraft in relatively low altitude earth orbit, i.e., earth orbits on the order of 100 miles, where the plasma densities are much greater and the particle energies are much lower, have variations that are typically ±5 volts.

In certain types of spacecraft, the induced voltages have caused different, electrically isolated segments of the spacecraft surface to assume different potentials. For example, if different, electrically isolated portions of a spacecraft surface, are differentially illuminated by the sun, different potentials are established between these different parts. The potential difference can become great enough to cause an electric discharge between the different segments, resulting in damage to electronic circuitry within the spacecraft. If the entire spacecraft surface is maintained at the same potential, e.g., at the potential of the plasma through which the spacecraft travels, the problem of electric discharge between the different parts of the spacecraft surface is avoided and the destruction of electronic components within the spacecraft due to the discharge is thereby obviated.

If a differential potential occurs between the spacecraft surface and the plasma through which a spacecraft is traveling, it has an adverse effect on instruments to measure the characteristics of charged particles encountered in spacecraft flight. In particular, such a potential difference has an effect on the trajectories of particles impacting on the instruments so that inaccurate indications of the particle trajectories quantities and other characteristics are likely to result.

BRIEF DESCRIPTION OF THE INVENTION

In accordance with the present invention, the potential induced on the surface of the spacecraft is neutralized to the potential of a plasma through which the spacecraft travels by emitting charged particles into the plasma from the surface. The charged particles have the same polarity as the induced potential to provide the neutralization. In accordance with one embodiment of the invention, a negative induced surface potential is neutralized by electrons that are thermionically emitted from a hot filament having a relatively high work function, i.e., a bare metal, uncoated filament. It is advantageous to utilize a high work function filament, rather than a coated filament, because a high work function filament does not have the danger of being poisoned, nor is there any requirement for the filament to be heated prior to activation thereof to an electron emitting state. Preferably, the filament is a bare wire that extends parallel to the spacecraft surface to provide a maximum coverage area with a minimum size filament.

In accordance with another embodiment of the invention, the charged particles are positive ions, or electrons, derived from a neutral plasma. The plasma can be the neutralized exhaust beam of an ion engine that propels the spacecraft, or simply the plasma produced by the ion engine neutralizer. The neutralizer provides a plasma comprising positive ions and electrons at an orifice on or near the spacecraft surface or skin. The charged particles emitted from the plasma are either positive ions or electrons, depending upon the polarity of the surface relative to the ambient plasma.

If the invention is utilized to maintain different electrically isolated parts of the spacecraft exterior surface at the same potential as the ambient plasma, a different charged particle emitter is provided for each of the electrically isolated parts, provided the parts are metal, i.e., conductive. If it is desired to prevent voltage differences between a dielectric segment of the exterior surface, many different emitters must be provided for the segment; each of the different emitters neutralizes the voltage for the surface in its immediate vicinity.

It is accordingly an object of the present invention to provide a method of and apparatus for neutralizing a potential induced on the surface of a spacecraft relative to the potential of a plasma through which the spacecraft travels, wherein the potential is induced on the surface in response to bombardment by charged particles on the spacecraft surface.

Another object of the invention is to provide a new and improved apparatus for and method of preventing electric discharges between different parts of a spacecraft surface that are electrically isolated from each other.

A further object of the invention is to provide a new and improved method of and apparatus for reducing damage to electrical components included within an orbiting spacecraft.

A further object of the invention is to provide a new and improved method of and apparatus for enabling more precise measurements of outer space particles to be derived.

The above and still further objects, features and advantages of the present invention will become apparent upon consideration of the following detailed description of several specific embodiments thereof, especially when taken in conjunction with the accompanying drawing.

BRIEF DESCRIPTION OF THE DRAWING

The single FIGURE is a somewhat schematic illustration of a spacecraft incorporating the different embodiments of the invention, in connection with its use as a device to protect electronic components within the spacecraft, as well as to provide more accurate operation of particle analyzing apparatus carried on the spacecraft exterior surface.

DETAILED DESCRIPTION OF THE DRAWING

Reference is now made to the drawing wherein there is illustrated a spherical spacecraft 11 having three electrically isolated, exterior surface parts or segments, formed as metal skins 12, 13 and 14, between which are located dielectric surface segments 10. Spacecraft 11 is in orbit, either solar or earth; the earth orbit may be either of the low orbiting type, such as between 100 and 500 miles, or of the synchronous type. As spacecraft 11 travels through outer space, it is considered to be moving through an ambient plasma assumed to be at a reference potential. As spacecraft 11 travels through the ambient plasma, it is bombarded by charged particles having positive and negative polarities; the particles originate outside of the ambient plasma and range from extremely low to extremely high energy levels, between zero to $10^{10}$ electron volts. Charged particles may also flow from the spacecraft. For example, photoelectrons are emitted from metal surface segments 12–14 in response to solar illumination of the metal surfaces. In response to the charged particle bombardment of the surface of spacecraft 11, a potential different from that of the ambient plasma is induced on the spacecraft surface. In the case of a synchronous satellite, wherein metal surface segment 12 is subjected to solar radiation for prolonged time periods and metal surface segment 14 is not exposed to solar irradiation, photoelectrons emitted from surface segment 12 offset the flow of energetic electrons and keep surface segment 12 at or near the ambient plasma potential. In contrast, dark metal surface segment 14 does not have the relieving benefit of the photoelectrons and may achieve potentials as great as −14,000 volts.

It is important to neutralize the potentials induced on the different surface segments 12–14 of spacecraft 11 so that all of the segments have the same potential as the ambient plasma. In particular, spacecraft 11 usually includes an electronic circuit 15 in its interior volume. Electronic circuit 15 includes semiconductor elements, such as bipolar transistors, metal oxide semiconductor field effect transistors, and other elements which are susceptible to erroneous operation, or possible destruction, if it is subject to an electric discharge that occurs between electrically isolated outer segments 12–14 of spacecraft 11. Further, mounted on exterior surface segment 13 of spacecraft 11 is a charged particle analyzer 16 for enabling measurements to be made on the nature of charged particles in outer space. Analyzer 16 may take the form disclosed in U.S. Pat. No. 3,626,189 to Otto Berg or U.S. Pat. No. 3,715,590 to Siegfried Auer, both of which are commonly assigned with the present application. If surface 13 on which charged particle analyzer 16 is mounted is at a potential different from that of the plasma through which spacecraft 11 is moving, the trajectories of the charged particles impinging on the analyzer are likely to be changed in response to the potential difference between the plasma surrounding the spacecraft and the potential of the spacecraft surface on which the particle analyzer is mounted.

In accordance with the present invention, the potentials induced in the different surface segments 12–14 of spacecraft 11 are neutralized so that they are all equal to each other and to the potential of the ambient plasma through which spacecraft 11 travels. By maintaining the entire surface of spacecraft 11 at the same potential, electric discharges through electronic circuit 15 are reduced, and the trajectories of charged particles impinging on analyzer 16 are not affected by the spacecraft. Basically, the method of and apparatus for maintaining the surface of spacecraft 11 at the same potential as the ambient plasma involves providing a source of charged particles in proximity to the spacecraft surface and allowing the charged particles to flow in an unimpeded manner into the plasma from the spacecraft surface. If a particular spacecraft surface segment is expected to assume a negative potential, the charged particles are electrons or negative ions; if the spacecraft surface segment is expected to assume a positive charge, the charged particles are positive ions. For the illustrated spacecraft 11, it is assumed that negative potentials are induced in metal surface segments 12 and 14 and that a positive potential is induced in metal surface segment 13 in response to the charged particle bombardment thereof.

Neutralization of the negative potentials induced in surface segments 12 and 14 is achieved by emitting electrons from surfaces 12 and 14 into the plasma surrounding the segments. The electrons are preferably derived from thermionic electron emitters 17 and 18, positioned approximately one-quarter inch above the surfaces 12 and 14, and extending approximately one-half inch across and parallel to surface segments 12 and 14. Electron emitters 17 and 18 are bare wire filaments preferably formed of tantalum doped with 50 parts per million of yttrium to inhibit grain growth of the tantalum. Each filament has a diamter of approximately 0.007 inches and is heated to a temperature of approximately 1800° Centrigrade in response to the D.C. potential applied to the filaments by sources 19 and wires 20 which extend through dielectric, sealing grommets 21 on surface segments 12 and 14. Since filaments 17 and 18 are formed of tantalum doped with yttrium, rather than being wires coated with electron emitting substances, such as barium oxide, there is no danger of the filaments being poisoned by a reaction of the coating with a contaminant, nor is it necessary to preheat the filament to activate it to be an electron emitter.

One terminal of each of filaments 17 and 18 is connected to one terminal of supplies 19 and 19', while the other terminal of the filaments is connected to the opposite, grounded terminals of supplies 19 and 19'; the grounded terminals of each of supplies 19 and 19' are connected, by a short circuit, to its adjacent metal surface 12 or 14 and to the ground terminal of any electronic circuit 15 contained thereunder so that the electronic circuit and the filaments are at a common, spacecraft reference potential equal to the ambient plasma potential. Because of the short circuit between the grounded end of power supply 19 and surface 12 and the connection of filament 17 to the high voltage side of supply 19, electrons emitted from the filament are effectively emitted from the spacecraft surface.

Because filaments 17 and 18 lie parallel to the surface of spacecraft surface segments 12 and 14 and are positioned above the spacecraft surfaces, an unimpeded path is provided for the electrons emitted by filaments 17 and 18 to the ambient plasma through which spacecraft 11 is traveling. The electrons emitted by filaments 17 and 18 flow into the plasma resulting in a net flow of electrons; the net electron flow occurs because of the common ground terminal arrangement from segments 12 and 14 into the plasma. The electron flow from the spacecraft surface segments 12 and 14 into the ambient plasma causes the surface segments 12 and 14 to be maintained at the same potential as the ambient plasma.

To neutralize the positive potential induced on surface segment 13 in response to positive charged particles bombarding surface 13, a positive ion flow is established into the plasma from surface segment 13. A convenient positive ion source is neutralizer exhaust tube 24 included in an ion propulsion engine for spacecraft 11. The ion engine includes a supply reservoir 25 of gaseous material, preferably cesium, which is delivered to metal exhaust tube 24 through flow control valve 26. Tube 24 terminates at orifice 27 on surface segment 13. A discharge is maintained through the gaseous material between the cathode orifice 27 and the anode probe 28 to produce a neutral plasma of positive ions and electrons. Probe 28 is positively biased relative to the metal wall of tube 24 by D.C. source 29 and is insulated from tube 24 by a suitable insulating sleeve 30. Typically, probe 28 is positively biased by approximately 15 volts relative to the potential of tube 24 in order to maintain the discharge. Positive ions flow from the plasma discharge between orifice 27 and probe 28, into the ambient plasma surrounding surface segment 13 to neutralize the positive voltage induced in surface segment 13. Likewise, electrons flow from the plasma discharge to neutralize any negative voltage that might be induced in surface 13 at some other time. In experiments actually conducted, it was found that the relatively small neutralizer exhaust mass flow rate of approximately $2 \times 10^{-8}$ pounds per second would neutralize the high potential built up on a metallic spacecraft surface during a solar eclipse. This result is surprising since the current from neutralizer exhaust tube 24 is only 5 percent of the equivalent 5ma current of the ion engine propulsion beam, i.e., a current of 250 microamperes. Since surface segments 12–14 are all at the same potential as the ambient plasma through which spacecraft 11 is traveling, all of surface segments 12–14 are at the same potential.

While there has been described and illustrated several specific embodiments of the invention, it will be clear that variations in the details of the embodiments specifically illustrated and described may be made without departing from the true spirit and scope of the invention as defined in the appended claims. For example, in one embodiment of the invention which was actually tested, it was found that an electron emitter located in a cavity in a spacecraft exterior metal surface segment was able to neutralize the negative potential of a metallic surface since an unimpeded electron path flow from the filament into the ambient plasma was provided.

What is claimed is:

1. A method of preventing electric discharges between different metal segments of a vehicular surface, said segments being electrically isolated from each other so that different voltage magnitudes and/or polarities are induced in them relative to the potential of an ambient plasma through which the vehicle travels, said different voltages being induced in response to differential bombardment of the different segments by charged particles, comprising directing charged particles into the ambient plasma from the different segments, the particles having the same polarity as the potential induced in the different segments so that the different segments have approximately the same potential.

2. The method of claim 1 wherein the potential induced in one of the segments is negative and the particles emitted from said one surface are electrons.

3. The method of claim 2 wherein the electrons are thermionically emitted from a hot filament having a relatively high work function.

4. The method of claim 1 wherein the potential induced in one of the segments is susceptible of being positive and negative and directing a plasma of positive ions and electrons into the ambient plasma from said one surface segment.

5. The method of claim 4 wherein the plasma has a mass flow rate approximately equal to the mass flow rate of a neutralizer exhaust of an ion engine.

6. Apparatus for preventing electric discharges between different segments of a vehicular exterior surface so that electric components within the vehicle are not adversely affected by the discharges, said segments being electrically isolated from each other so that there is a susceptibility for different voltage magnitudes and/or polarities to be induced in them relative to the potential of a plasma through which the vehicle travels, said different voltages being induced in response to differential bombardment of the different segments by charged particles, comprising a separate charged particle emitter located in proximity to each of the segments, each of said emitters emitting charged particles having the same polarity as the potential of the part with which it is proximately located, each of said emitters being positioned so that charged particles are directed by it into the plasma from the surface with which it is in proximity.

7. The apparatus of claim 6 further including electric power supply means for applying a biasing voltage between terminals of at least a portion of one of the emitters, one of said terminals being directly connected to a ground terminal of the circuitry.

8. The apparatus of claim 7 wherein the emitter is a filament extending above the vehicular surface.

9. The apparatus of claim 7 wherein the emitter is a bare filament consisting primarily of a high work function metal.

10. The apparatus of claim 9 wherein the metal is tantalum doped with yttrium.

11. The apparatus of claim 6 wherein the potential for one of the segments is susceptible of being positive or negative and the emitter is a plasma source of positive and negative charged particles, positive particles being emitted from the source in response to the potential from the one segment being positive and negative particles being emitted from the source in response to the potential for the one segment being negative.

12. The apparatus of claim 11 wherein the plasma source of positive and negative charged particles comprises a neutral plasma created by a discharge at the vehicular exterior surface.

13. The apparatus of claim 11 wherein the plasma source comprises a gaseous material flowing from the vehicular interior toward the vehicular exterior surface, a biased electrode positioned in the path of the flowing gas so that a plasma discharge is maintained in the gas between the electrode and an orifice on the vehicular surface for enabling charged particles to flow into the ambient plasma through which the vehicle travels.

* * * * *